US011041622B2

(12) United States Patent
Cadima

(10) Patent No.: US 11,041,622 B2
(45) Date of Patent: Jun. 22, 2021

(54) GAS COOKTOP WITH POWER MANAGEMENT

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/239,661

(22) Filed: Jan. 4, 2019

(65) Prior Publication Data

US 2020/0217503 A1 Jul. 9, 2020

(51) Int. Cl.
*F23N 1/00* (2006.01)
*F24C 3/12* (2006.01)

(52) U.S. Cl.
CPC ..... *F23N 1/002* (2013.01); *F23N 1/005* (2013.01); *F24C 3/122* (2013.01); *F24C 3/126* (2013.01); *F23N 2235/16* (2020.01)

(58) Field of Classification Search
CPC . F23N 1/00; F23N 1/002; F23N 1/005; F23N 5/242; F23N 2237/02; F23N 2235/16; F24C 3/122; F24C 3/126
See application file for complete search history.

(56) References Cited

U.S. PATENT DOCUMENTS

| | | | | |
|---|---|---|---|---|
| 8,033,279 | B2 * | 10/2011 | Shaffer | F24C 3/126 126/1 R |
| 8,783,243 | B2 * | 7/2014 | Hodapp, Jr. | F24C 3/126 126/39 BA |
| 9,587,836 | B2 * | 3/2017 | Begero | F23N 1/005 |
| 9,841,191 | B2 * | 12/2017 | Johncock | F23N 1/005 |
| 10,024,545 | B2 * | 7/2018 | Johncock | F24C 7/087 |
| 10,429,075 | B2 * | 10/2019 | Cadima | F24C 3/126 |
| 10,485,379 | B2 * | 11/2019 | Bennett | H05B 1/0266 |
| 10,655,866 | B2 * | 5/2020 | Ha | F24C 15/22 |
| 2009/0250454 | A1 * | 10/2009 | Egenter | H05B 6/065 219/620 |
| 2011/0294078 | A1 * | 12/2011 | Gartner | F23N 1/002 431/12 |
| 2018/0008095 | A1 * | 1/2018 | Bennett | A47J 37/0786 |

FOREIGN PATENT DOCUMENTS

JP 4440836 B2 3/2010

* cited by examiner

*Primary Examiner* — David J Laux
(74) *Attorney, Agent, or Firm* — Dority & Manning, P.A.

(57) ABSTRACT

A gas cooktop includes one or more gas burners on a top panel. A high output gas burner is also positioned on the top panel. The high output gas burner is separate from each of the one or more gas burners. The high output gas burner has a maximum heat output greater than each of the one or more gas burners. An electronic control valve is coupled to a supply line of the high output gas burner. The electronic control valve is operable to adjust a flow rate of fuel through the supply line of the high output gas burner. A controller is in communication with the electronic control valve and the one or more control valves. The controller is configured for throttling the maximum heat output of the high output gas burner with the electronic control valve.

15 Claims, 6 Drawing Sheets

| Example | 144 | 146 | 148 | 150 | 160 |
|---|---|---|---|---|---|
| 1 | Off | Off | Off | Off | Off |
| 2 | Off | Off | Off | Off | 100% |
| 3 | Off | Off | Off | On | 100% |
| 4 | Off | Off | On | Off | 100% |
| 5 | Off | On | Off | Off | 100% |
| 6 | On | Off | Off | Off | 100% |
| 7 | On | On | Off | Off | 100% |
| 8 | Off | On | On | Off | 100% |
| 9 | Off | Off | On | On | 100% |
| 10 | On | On | On | Off | 100% |
| 11 | Off | On | On | On | 100% |
| 12 | On | On | On | On | 80% |

FIG. 5

GAS COOKTOP WITH POWER MANAGEMENT

FIELD OF THE INVENTION

The present subject matter relates generally to gas cooktop appliances.

BACKGROUND OF THE INVENTION

Conventional gas cooking appliances have one or more burners. A mixture of gaseous fuel and air combusts at the burners to generate heat for cooking. To avoid overheating the cooktop appliance and/or adjacent cabinetry and walls, a maximum total power output of the one or more burners is generally limited. In gas cooking appliances with large numbers of gas burners, the limited maximum total power output can be inconvenient.

Generally, gas cooking appliances are tested in a worst case scenario, i.e., with all burners operating at maximum output, and the power output of one or more of the gas burners is limited to avoid exceeding the total power output limit at this worst case scenario. However, gas cooking appliances with large numbers of gas burners are rarely operated with all gas burners at their respective maximum output. Thus, the power output of the one or more of the gas burners may be needlessly limited to avoid rare circumstances.

BRIEF DESCRIPTION OF THE INVENTION

Aspects and advantages of the invention will be set forth in part in the following description, or may be apparent from the description, or may be learned through practice of the invention.

In a first example embodiment, a gas cooktop includes a top panel and one or more control valves. One or more gas burners are positioned on the top panel. Each of the one or more control valves is coupled to a respective supply line of the one or more gas burners. Each of the one or more control valves is operable to adjust a flow rate of fuel through the respective supply line. A high output gas burner is positioned on the top panel. The high output gas burner is separate from each of the one or more gas burners. The high output gas burner has a maximum heat output greater than each of the one or more gas burners. An electronic control valve is coupled to a supply line of the high output gas burner. The electronic control valve is operable to adjust a flow rate of fuel through the supply line of the high output gas burner. A controller is in communication with the electronic control valve and the one or more control valves. The controller is configured for receiving a signal from each of the one or more control valves that is indicative of a respective operating state of the one or more gas burners. The controller is configured for throttling the maximum heat output of the high output gas burner with the electronic control valve when a number of active gas burners in the one or more gas burners exceeds a threshold value.

In a second example embodiment, a gas cooktop includes a top panel. One or more gas burners is positioned on the top panel. A high output gas burner is positioned on the top panel. The high output gas burner is separate from each of the one or more gas burners. The high output gas burner has a maximum heat output greater than each of the one or more gas burners. The gas cooktop also includes a plurality of electronic control valves. Each of the plurality of electronic control valves is coupled to a respective supply line of the one or more gas burners and the high output gas burner. Each of the plurality of electronic control valves is operable to adjust a flow rate of fuel through the respective supply line. A controller is in communication with the plurality of electronic control valves. The controller is configured for receiving a signal from each of the plurality of electronic control valves for the one or more gas burners that is indicative of a respective operating state of the one or more gas burners. The controller is also configured for throttling the maximum heat output of the high output gas burner with the electronic control valve when a number of active gas burners in the one or more gas burners exceeds a threshold value.

In a third example embodiment, a gas cooktop includes a top panel. One or more gas burners is positioned on the top panel. A high output gas burner is positioned on the top panel. The high output gas burner is separate from each of the one or more gas burners. The high output gas burner has a maximum heat output greater than each of the one or more gas burners. The gas cooktop also includes a plurality of electronic control valves. Each of the plurality of electronic control valves is coupled to a respective supply line of the one or more gas burners and the high output gas burner. Each of the plurality of electronic control valves is operable to adjust a flow rate of fuel through the respective supply line. A controller is in communication with the plurality of electronic control valves. The controller is configured for receiving a signal from each of the plurality of electronic control valves for the one or more gas burners that is indicative of a respective heat output of the one or more gas burners. The controller is also configured for throttling the maximum heat output of the high output gas burner with the electronic control valve to a heat output that is proportional a total sum of the heat outputs of the one or more gas burners.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 5 is a table of power outputs of a high output burner with other burners in various operating states according to an example embodiment of the present subject matter.

DETAILED DESCRIPTION

Figure 1:
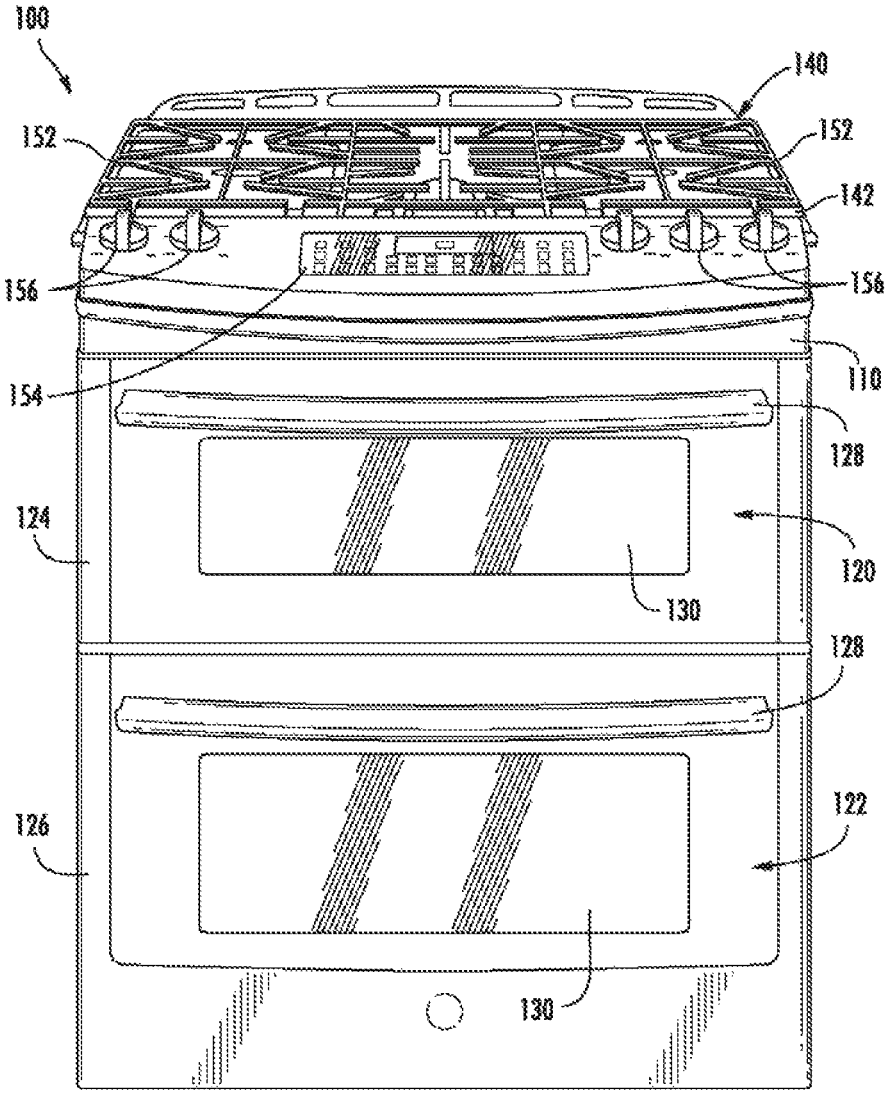
FIG. 1 is a front, perspective view of a range appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
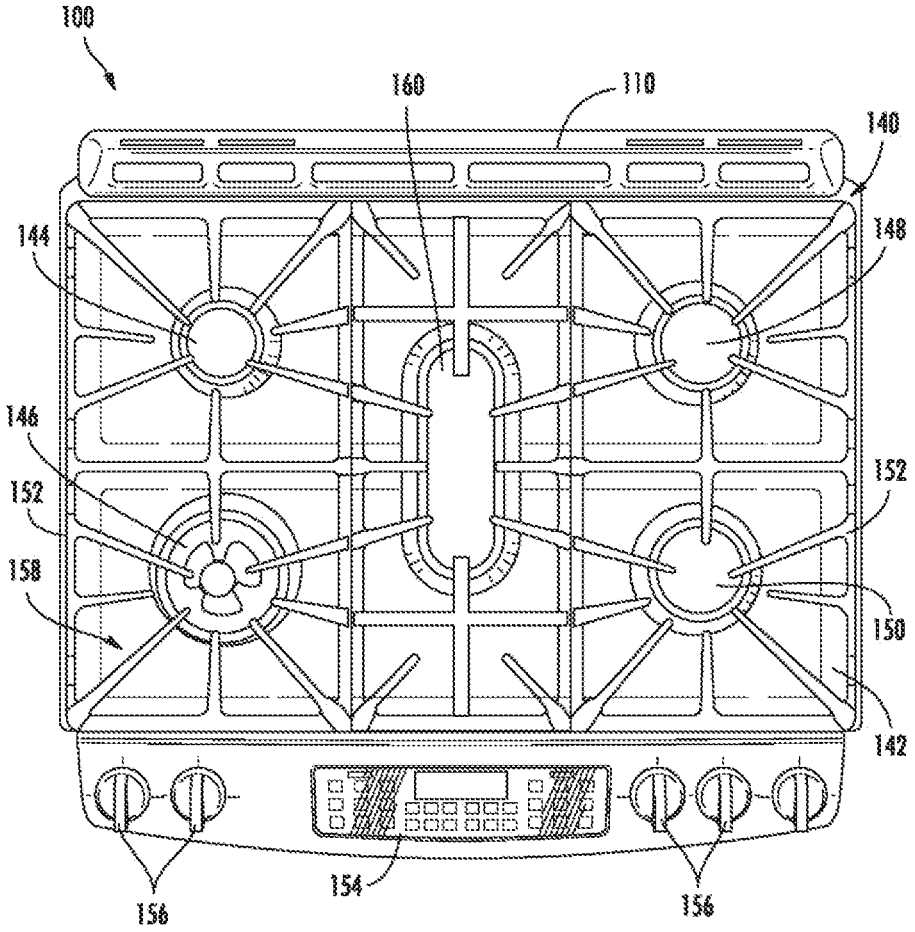
FIG. 2 is a top, plan view of the example range appliance of FIG. 1.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the example embodiment shown in FIG. 1 is not intended to limit the present subject matter to any particular cooking chamber configuration or gas burner arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124, 126 to assist a user with opening and closing doors 124, 126 in order to access cooking chambers 120, 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124, 126 are closed and also assist with insulating upper and lower cooking chambers 120, 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burners 144, 146, 148, 150. Burners 144, 146, 148, 150 provide thermal energy to cooking utensils on grates 152. Range appliance 100 may include any suitable number of burners 144, 146, 148, 150. For example, as shown in FIG. 2, range appliance 100 may have no less than four burners 144, 146, 148, 150. Burners 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142.

Range appliance 100 also includes a high output burner 160 positioned at a middle portion of top panel 142, as may be seen in FIG. 2. High output burner 160 is separate from burners 144, 146, 148, 150 on top panel 142. High output burner 160 may have a maximum heat output greater than each of burners 144, 146, 148, 150, Thus, e.g., high output burner 160 may include air handlers, such as fans, pumps, etc., for forcing air to flame ports of high output burner 160 to thereby increase a heat output of high output burner 160 relative to burners 144, 146, 148, 150 that may be naturally aspirated. As another example, high output burner 160 may be a griddle burner.

A user interface panel 154 is located within convenient reach of a user of the range appliance 100. For this example embodiment, user interface panel 154 includes knobs 156 that are each associated with one of burners 144, 146, 148, 150 and high output burner 160. Knobs 156 allow the user to activate each burner and determine the amount of heat input provided by each burner 144, 146, 148, 150 and high output burner 160 to a cooking utensil located thereon. User interface panel 154 may also be provided with one or more graphical display devices that deliver certain information to the user such as e.g., whether a particular burner is activated and/or the rate at which the burner is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
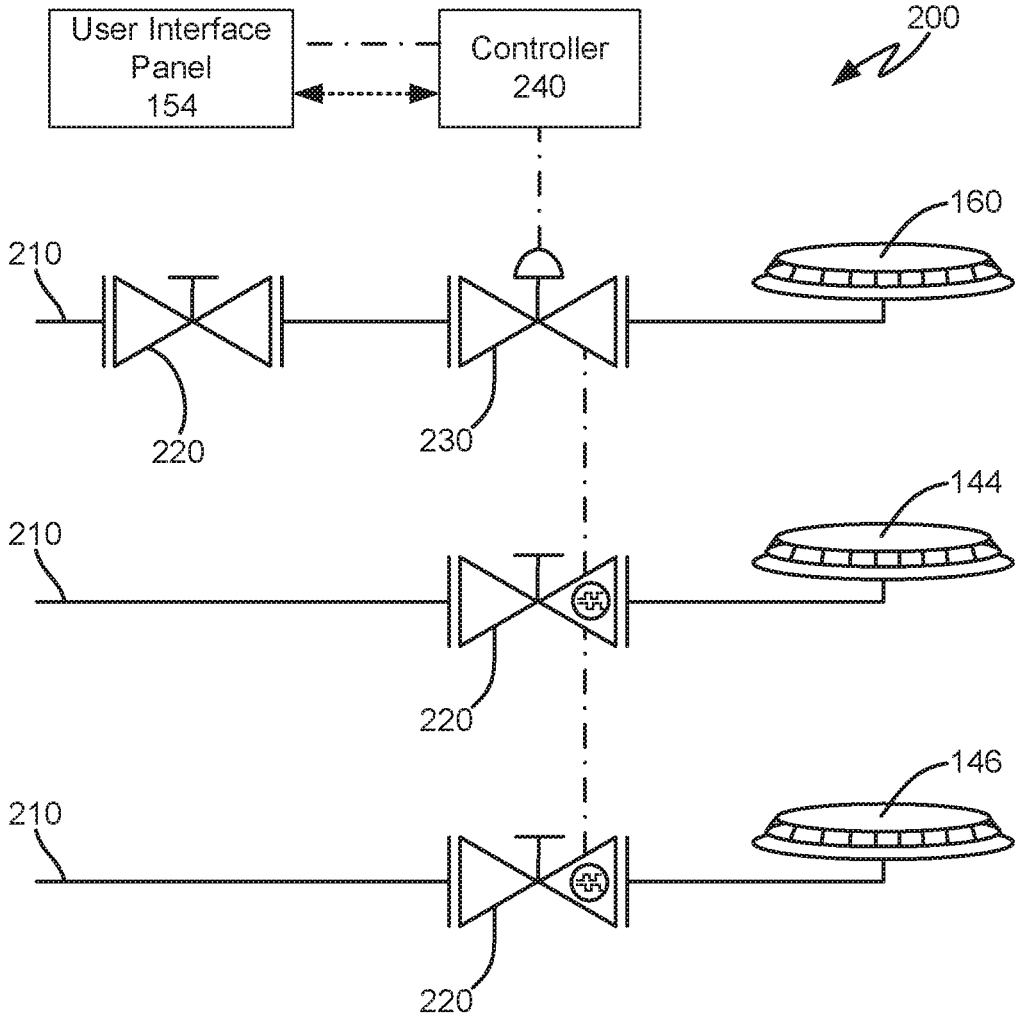
FIG. 3 is a schematic view of certain components of the example range appliance of FIG. 1.

FIG. 3 is a schematic view of certain components of range appliance 100. In particular, as shown in FIG. 3, range appliance 100 includes a fuel supply system 200. Fuel supply system 200 includes supply lines 210, manual control valves 220 and an electronic control valve 230. Supply line 210 may be metal tubes, such copper or aluminum tubing, that are connectable to a fuel supply. Thus, supply lines 210 may receive a flow of pressurized gaseous fuel, e.g., natural gas or propane, from the fuel supply. Supply lines 210 also extend to burners 144, 146, 160 within cabinet 110 below top panel 142. Thus, the gaseous fuel may flow from the fuel supply to burners 144, 146, 160 through supply line 210.

Manual control valves 220 are coupled to supply lines 210 and are configured for regulating the flow of gaseous fuel through supply line 210 to burner 144. In particular, each of the manual control valves 220 may be coupled to one of knobs 156 such that manual control valves 220 are manually adjustable via knobs 156 to regulate the flow of gaseous fuel to burners 144, 146, 160. For example, a user may rotate a knob 156 coupled to the manual control valve 220 of burner 144 to a "HI" setting in order to maximize the flow of gaseous fuel to burner 144, and the user may rotate the knob 156 coupled to the manual control valve 220 of burner 144 to a "LO" setting in order to minimize the flow of gaseous fuel to burner 144. In addition, the user may rotate the knob 156 to a setting between the "HI" and "LO" settings to adjust the flow of gaseous fuel to burner 144 between the maximum and minimum flows, or the user may rotate the knob 156 coupled to the manual control valve 220 of burner 144 to a "OFF" setting in order to terminate the flow of gaseous fuel to burner 144. Thus, it will be understood that manual control valve 220 may be a standard manual surface burner valve, in certain example embodiments. Although not shown in FIG. 3, the other burners 148, 150 may be connected to supply lines 210 in a similar manner. In particular, each of burners 148, 150 may have a respective manual control valve 220, in certain example embodiments.

Electronic control valve 230 is also coupled to the supply line 210 of high output burner 160. In FIG. 3, electronic control valve 230 is connected in series between the manual control valve 220 on the supply line 210 of high output burner 160 and high output burner 160. Thus, electronic control valve 230 may be positioned downstream of the manual control valve 220 on supply line 210 of high output burner 160 relative to the flow of fuel from the fuel source. In such a manner, electronic control valve 230 may further regulate the flow of gaseous fuel to high output burner 160 after the manual control valve 220 on supply line 210 of high output burner 160.

Electronic control valve 230 may be an electronic pressure regulating valve, a motorized valve, a modulating valve, a solenoid valve, or some other variable type gas flow valve. Thus, electronic control valve 230 may be automatically adjusted to regulate the flow of gaseous fuel to high output burner 160, e.g., rather than being manually actuated as with manual control valves 220. In particular, range appliance 100 includes a controller 240 that regulates various components of range appliance 100. Controller 240 is in operative communication with various components of range appliance 100, such electronic control valve 230. Thus, controller 240 may adjust electronic control valve 230 in order to regulate the flow of gaseous fuel to high output burner 160.

In certain example embodiments, the supply line 210 of high output burner 160 does not include a manual control valve 220. Thus, e.g., the flow of gaseous fuel to high output burner 160 may be solely regulated by electronic control valve 230 on the supply line 210 to high output burner 160. A user may input a heat setting for high output burner 160 on user interface panel 154, and electronic control valve 230 may adjust the flow of gaseous fuel to high output burner 160 through the supply line 210 of high output burner 160 in response.

Controller 240 includes memory and one or more processing devices such as microprocessors, CPUs or the like, such as general or special purpose microprocessors operable to execute programming instructions or micro-control code associated with operation of range appliance 100. The memory can be non-transitory and represent random access memory such as DRAM, or read only memory such as ROM or FLASH. The processor executes programming instructions stored in the memory. The memory can be a separate component from the processor or can be included onboard within the processor. Alternatively, controller 240 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Each of manual control valves 220 on the supply lines 210 of burners 144, 146 may include an encoder that is operable to detect a position of the knob 156 coupled to manual control valves 220 on the supply lines 210 of burners 144, 146. Thus, e.g., for burner 144, encoder in the manual control valve 220 on the supply line 210 of burner 144 is operative to generate a signal that is indicative of an operating state of burner 144. In certain example embodiments, the encoder in the manual control valve 220 on the supply line 210 of burner 144 may be operable to output an open signal when the manual control valve 220 on the supply line 210 of burner 144 is open and/or a closed signal when the manual control valve 220 on the supply line 210 of burner 144 is closed. Thus, e.g., the encoder in the manual control valve 220 on the supply line 210 of burner 144 may be a binary switch. In other example embodiments, the encoder in the manual control valve 220 on the supply line 210 of burner 144 may be more complex to increase a resolution of the encoder. In particular, in addition to the off state, the encoder in the manual control valve 220 on the supply line 210 of burner 144 may be operable to output a maximum signal when the manual control valve 220 on the supply line 210 of burner 144 is fully open and/or an intermediate signal when the manual control valve 220 on the supply line 210 of burner 144 is between fully open and closed. The encoder may be operable to detect various intermediate settings of the manual control valve 220 on the supply line 210 of burner 144. The encoders in manual control valves 220 for burners 146, 148, 150 may be configured in the same or similar manner to that described above for the manual control valve 220 of burner 144.

Figure 6:
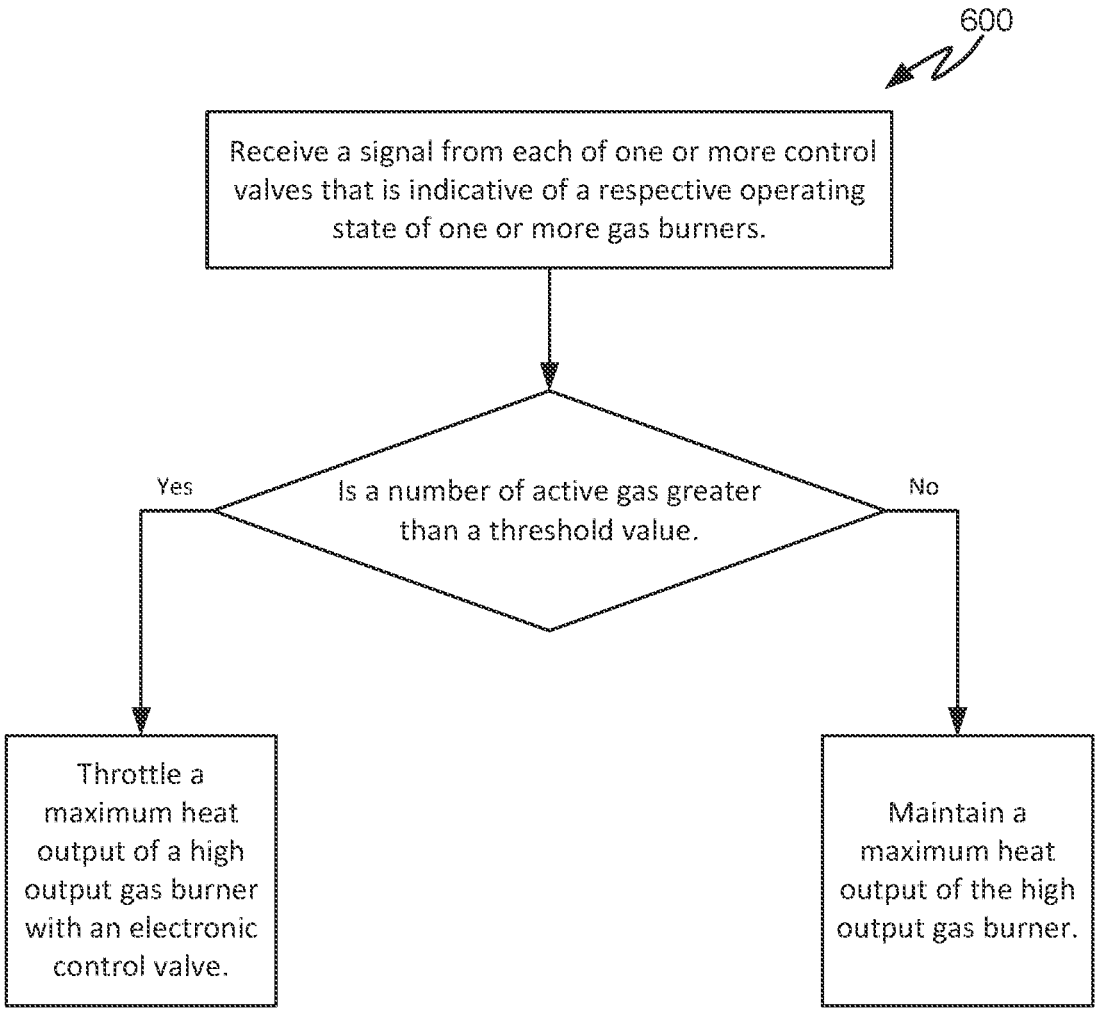
FIG. 6 is a flowchart of power management of a cooktop appliance, according to an example embodiment of the present subject matter.

FIG. 6 is an example flowchart 600 of power management for controller 240. Controller 240 may be in communication with the encoders of the manual control valves 220 for burners 144, 146, 148, 150. Thus, as shown in FIG. 6, controller 240 may receive a signal from each of the manual control valves 220 for burners 144, 146, 148, 150 that is indicative of a respective operating state of burners 144, 146, 148, 150, including whether each of the burners 144, 146, 148, 150 is active. Controller 240 is also configured for throttling the maximum heat output of high output burner 160 with electronic control valve 230 when a number of active burners 144, 146, 148, 150 exceeds a threshold value. For example, controller 240 may adjust electronic control valve 230 to decrease the maximum flow rate of gaseous fuel through the supply line 210 of high output burner 160. Thus, a maximum volume of gaseous fuel supplied to high output burner 160 through supply line 210 of high output burner 160 is decreased with electronic control valve 230 when the number of active burners 144, 146, 148, 150 exceeds a threshold value.

The threshold value may be any suitable number of gas burners. For example, the threshold value may be three (3), four (4) or more active burners. As another example, the threshold value may be one less than the total number of burners on range appliance 100, e.g., other than high output burner 160.

By throttling high output burner 160, the heat output of the high output burner 160 is decreased from the maximum heat output of high output burner 160. As an example, the maximum heat output of the high output burner 160 may be no less than fifteen thousand British thermal units per hour (15000 BTU/hr) when high output burner 160 in not throttled by electronic control valve 230, and throttling high output burner 160 may decrease the heat output of the high output burner 160 to any suitable amount from the maximum heat output. For example, the heat output of the high output burner 160 may throttled from the maximum heat output of the high output burner 160 by five percent (5%), ten percent (10%), twenty percent (20%) or more in response to the number of active burners 144, 146, 148, 150 exceeding the threshold value. In the example, shown in FIG. 5, high output burner 160 is throttled to eighty percent (80%) of the maximum heat output of high output burner 160 when all of burners 144, 146, 148, 150 are active. Conversely, high output burner 160 is operable at one hundred percent (100%) of the maximum heat output of high output burner 160 when three or less of the burners 144, 146, 148, 150 are active Throttling high output burner 160 when the number of active burners 144, 146, 148, 150 exceeds the threshold value advantageously avoids overheating range appliance 100 and/or adjacent cabinetry or walls when a large number of burners are active on range appliance 100. Conversely, high output burner 160 may be unthrottled and operable at the maximum heat output of high output burner 160 when a smaller number of burners are active on range appliance 100. In such a manner, operation of high output burner 160 may be adjusted to modify the heat output of high output burner 160 based upon the operation of burners 144, 146, 148, 150.

Figure 4:
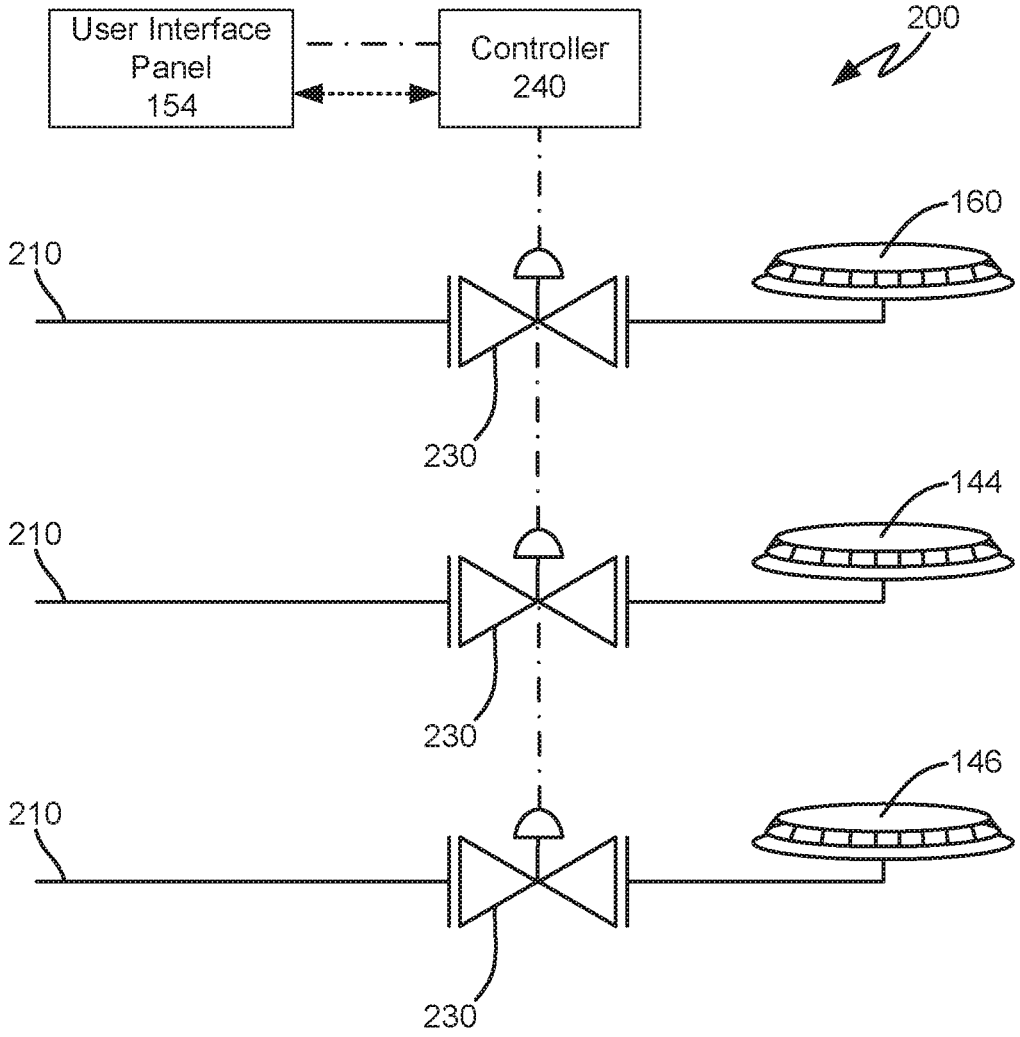
FIG. 4 is a schematic view of certain components of the example range appliance of FIG. 1 according to another embodiment.

FIG. 4 is a schematic view of certain components of range appliance 100 according to another example embodiment. In FIG. 4, fuel supply system 200 does not include manual control valves 220. Rather, each of the supply lines 210 includes an electronic control valve 230. Thus, operation of burners 144, 146, 148, 150 is regulated by electronic control valves 230 in the example embodiment shown in FIG. 4. A user may input a heat setting for each of burners 144, 146, 148, 150 on user interface panel 154, and electronic control valves 230 may adjust the flow of gaseous fuel to burners 144, 146, 148, 150 through the supply lines 210 in response.

In FIG. 4, controller 240 is in communication with electronic control valves 230. Controller 240 may be configured for receiving a signal from each of electronic control valves 230 for burners 144, 146, 148, 150 that is indicative of a respective operating state of burners 144, 146, 148, 150, including whether each of the burners 144, 146, 148, 150 is active. Controller 240 may determine that burners 144, 146, 148, 150 are active when electronic control valves 230 are at least partially open such that gaseous fuel flows to burners 144, 146, 148, 150. Controller 240 is also configured for throttling the maximum heat output of high output burner 160 with electronic control valve 230 on the supply line 210 of high output burner 160 when the number of active burners 144, 146, 148, 150 exceeds the threshold value, e.g., in the manner described above.

Alternatively, controller 240 may be configured for receiving a signal from each of the electronic control valves 230 for burners 144, 146, 148, 150 that is indicative of a respective heat output of burners 144, 146, 148, 150. Controller 240 may determine the heat output of burners 144, 146, 148, 150 based upon the degree to which electronic control valves 230 are open and gaseous fuel flows to burners 144, 146, 148, 150. Controller 240 is also configured for throttling the maximum heat output of high output burner 160 with electronic control valve 230 on the supply line 210 of high output burner 160 to a heat output that is proportional a total sum of the heat outputs of burners 144, 146, 148, 150. Thus, the throttling high output burner 160 may be precise due to knowledge of the heat output of burners 144, 146, 148, 150. In particular, the throttling may be variable to minimize impact on performance of range appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas cooktop, comprising:

a top panel;

one or more gas burners positioned on the top panel;

one or more control valves, each of the one or more control valves coupled to a respective supply line of the one or more gas burners, each of the one or more control valves operable to adjust a flow rate of fuel through the respective supply line;

a high output gas burner positioned on the top panel, the high output gas burner separate from each of the one or more gas burners, the high output gas burner having a maximum heat output greater than each of the one or more gas burners;

an electronic control valve coupled to a supply line of the high output gas burner, the electronic control valve operable to adjust a flow rate of fuel through the supply line of the high output gas burner; and a controller in communication with the electronic control valve and the one or more control valves, the controller configured for receiving a signal from each of the one or more control valves that is indicative of a respective operating state of the one or more gas burners, the controller configured for determining a number of active gas burners in the one or more gas burners based on the signal from each of the one or more control valves, the controller configured for throttling the maximum heat output of the high output gas burner with the electronic control valve in response to the number of active gas burners in the one or more gas burners exceeding a threshold value, wherein the electronic control valve is fully open and does not decrease a maximum flow rate of gaseous fuel through the supply line to the high output gas burner when the number of active gas burners in the one or more gas burners does not exceed the threshold value, and wherein the electronic control valve is partially closed and decreases the maximum flow rate of gaseous fuel through the supply line to the high output gas burner when the number of active gas burners in the one or more gas burners exceeds the threshold value.

2. The gas cooktop of claim 1, wherein each of the one or more control valves comprises a manual control valve with an encoder that is operative to generate the signal that is indicative of the respective operating state of the one or more gas burners.

3. The gas cooktop of claim 2, wherein the encoder of each of the one or more control valves is operative to determine two operating states of the one or more gas burners, the two operating states of the one or more gas burners being active and inactive.

4. The gas cooktop of claim 2, wherein the encoder of each of the one or more control valves is operative to determine three or more operating states of the one or more gas burners, the three or more operating states of the one or more gas burners comprises inactive, maximum and intermediate.

5. The gas cooktop of claim 1, wherein the supply line of the high output gas burner is separate from the supply line of each of the one or more gas burners, and a high output gas burner manual control valve is coupled on the supply line of the high output gas burner such that the high output gas burner manual control valve is in series with the electronic control valve on the supply line of the high output gas burner.

6. The gas cooktop of claim 1, wherein the maximum heat output of the high output gas burner is no less than fifteen thousand British thermal units per hour when the high output gas burner in not throttled by the electronic control valve.

7. The gas cooktop of claim 1, wherein the controller is configured for throttling the maximum heat output of the high output gas burner with the electronic control valve such that a combined heat output of the one or more gas burners and the high output gas burner does not exceed a total allowable simultaneous heat output of the one or more gas burners and the high output gas burner.

8. The gas cooktop of claim 1, wherein the one or more gas burners comprises no less than four gas burners.

9. The gas cooktop of claim 1, wherein the threshold value is one less than a total number of the one or more gas burners.

10. The gas cooktop of claim 1, wherein the controller is configured for throttling the maximum heat output of the high output gas burner with the electronic control valve by a set percentage in response to the number of active gas burners in the one or more gas burners exceeding the threshold value.

11. A gas cooktop, comprising:

a top panel;

one or more gas burners positioned on the top panel;

a high output gas burner positioned on the top panel, the high output gas burner separate from each of the one or more gas burners, the high output gas burner having a maximum heat output greater than each of the one or more gas burners;

a plurality of electronic control valves, each of the plurality of electronic control valves coupled to a respective supply line of the one or more gas burners and the high output gas burner, each of the plurality of electronic control valves operable to adjust a flow rate of fuel through the respective supply line; and a controller in communication with the plurality of electronic control valves, the controller configured for receiving a signal from each of the plurality of electronic control valves for the one or more gas burners that is indicative of a respective operating state of the one or more gas burners, the controller configured for determining a number of active gas burners in the one or more gas burners based on the signal from each of the plurality of electronic control valves for the one or more gas burners, the controller configured for throttling the maximum heat output of the high output gas burner with the electronic control valve of the high output gas burner in response to the number of active gas burners in the one or more gas burners exceeding a threshold value, wherein the electronic control valve is fully open and does not decrease a maximum flow rate of gaseous fuel through the supply line to the high output gas burner when the number of active gas burners in the one or more gas burners does not exceed the threshold value, and wherein the electronic control valve is partially closed and decreases the maximum flow rate of gaseous fuel through the supply line to the high output gas burner when the number of active gas burners in the one or more gas burners exceeds the threshold value.

12. The gas cooktop of claim 11, wherein the maximum heat output of the high output gas burner is no less than fifteen thousand British thermal units per hour when the high output gas burner in not throttled by the electronic control valve.

13. The gas cooktop of claim 11, wherein the controller is configured for throttling the maximum heat output of the high output gas burner with the electronic control valve such that a combined heat output of the one or more gas burners and the high output gas burner does not exceed a total allowable simultaneous heat output of the one or more gas burners and the high output gas burner.

14. The gas cooktop of claim 11, wherein the one or more gas burners comprises no less than four gas burners.

15. The gas cooktop of claim 11, wherein the threshold value is one less than a total number of the one or more gas burners.

* * * * *